US005849378A

United States Patent [19]

Gask

[11] Patent Number: 5,849,378

[45] Date of Patent: Dec. 15, 1998

[54] VERTICAL RIGHT ANGLE PACKAGE HINGE

[75] Inventor: Bryan R. Gask, Fenton, Mo.

[73] Assignee: Taylor Packaging Corporation, Imperial, Mo.

[21] Appl. No.: 524,540

[22] Filed: Sep. 7, 1995

[51] Int. Cl.[6] ..... E05D 1/02; B65D 43/14

[52] U.S. Cl. ..... 428/35.7; 428/36.92; 428/122; 428/124; 428/130; 220/4.23; 220/339; 206/470; 16/225; 264/554

[58] Field of Search ..... 16/225, 227, 232; 220/4.23, 339; 206/470; 428/35.7, 36.92, 122, 124, 130; 264/544, 554

[56] References Cited

U.S. PATENT DOCUMENTS

| | | | |
|---|---|---|---|
| 3,256,892 | 6/1966 | Esposito, Jr. | 220/339 |
| 3,351,270 | 11/1967 | Hohnjec | 220/339 |
| 3,551,940 | 1/1971 | Edison | 220/4.23 |
| 3,596,822 | 8/1971 | Holley | 220/4.24 |
| 3,613,987 | 10/1971 | Laidman | 220/902 |
| 3,933,296 | 1/1976 | Ruskin et al. | 229/2.5 |
| 4,029,390 | 6/1977 | Chinnock et al. | 220/4.24 |
| 4,127,189 | 11/1978 | Shumrak et al. | 220/339 |
| 4,235,346 | 11/1980 | Liggett | 220/7 |
| 4,273,249 | 6/1981 | Florian | 220/339 |
| 4,553,692 | 11/1985 | Padonvani | 229/2.5 EC |
| 4,637,514 | 1/1987 | Kildea et al. | 220/4.23 |
| 4,700,835 | 10/1987 | Rongsvoog, Jr. | 206/411 |
| 4,703,853 | 11/1987 | Byrns | 206/509 |
| 4,753,366 | 6/1988 | Ritter | 220/339 |
| 4,784,268 | 11/1988 | Perchak | 206/470 |
| 4,962,854 | 10/1990 | Ricci | 206/387.1 |
| 5,002,184 | 3/1991 | Lloyd | 220/902 |
| 5,016,777 | 5/1991 | Marvin | 220/339 |
| 5,300,748 | 4/1994 | Colombo | 220/339 |
| 5,368,163 | 11/1994 | Gelardi | 206/387.1 |

*Primary Examiner*—Rena L. Dye
*Attorney, Agent, or Firm*—Blackwell Sanders Peper Martin

[57] ABSTRACT

A male thermoformed package hinge includes two sides, each having opposed ends extending therebetween. The hinge has a triangular cross-section, the sides intersecting at outer ends thereof and thus forming the apex of the triangular cross-sections. The hinge also has opposed flanges, extending substantially horizontally away from the lower ends of the sides in opposed directions when the hinge is positioned as on a male mold on which it is thermoformed, in which molding position the apex of the triangular cross-section of the hinge points away from the mold, and an imaginary line drawn from the first flange to the second flange forms the base of the triangular cross-section.

8 Claims, 9 Drawing Sheets

VERTICAL RIGHT ANGLE PACKAGE HINGE

BACKGROUND AND SUMMARY OF THE INVENTION

The present invention relates generally to the field of thermoformed packages, and, more particularly, to a thermoformed plastic package having an integral hinge which is formed during the molding process to extend away from the axis of the mold, in the same direction as the male product cavity forming portion of the mold, and which is triangular in cross-section.

Thermoforming is a well-known process for forming plastic packaging from roll stock of semi-rigid plastic sheet material. Typically, the sheeting is passed through a heating oven to a forming station where it is applied to either a "male" or "female" tool to form a package with a cavity shaped for containing a certain product having a more or less corresponding shape, such as, for example, a flashlight, a stapler, fresh fruit, personal care articles, etc.

Previously, thermoformed product packages, and particularly those of interest here and referred to as "clamshells", were formed with hinges referred to as "female", in that the hinge portion of such a package was formed during the molding process by pulling the heated roll stock downwardly, by vacuum, into a groove tooled into the mold, to thin the plastic for easier hinging. For purposes of this application, and for consistency, it is to be understood that, as is the practice in the art, when speaking of either the package or the mold from which that same package is formed, the terms "male" and "female" derive from the shape of the corresponding section of the mold.

For example, as shown in the mold in FIG. 4, the "male" portion is on the left side of the figure and the "female" portion is on the right. That is, if the mold panel extends upwardly, it is referred to as "male", and if it is formed with a concave tool, it is referred to as "female". The same eference terms are carried over to the package which results from a particular mold shape, so that although the product cavity of the resulting package may be concave, it is nevertheless referred to as "male", if it was formed on a male mold. If the package results in a cavity formed from a "female" mold (which may even be female on both sides of the mold, as in FIG. 9), the package section resulting will also be referred to as "female". The same approach is used in naming the package hinge portions.

In the type of plastic container especially of interest in the present invention, simultaneously with forming the package product cavity on one side or end of the tool, a cover for the cavity is also formed on the other end or side of the tool. The cover and cavity portions of the resultant plastic product (often referred to as a "clamshell") are connected by an integral hinge formed between the two portions, so that the package can be repeatedly opened and closed, as desired. For consistency, if the section of the mold upon which the hinge is formed is indented, for example, tooled into the mold as a channel, then the hinge resulting from that mold is referred to as "female".

Such hinged packages have typically been formed using a female cavity mold such as that illustrated, for example, in FIG. 9, and generally designated 310. One example of such a known thermoformed package 300 is shown schematically in FIGS. 10 and 11, with hinge 312 enlarged for clarity in FIG. 12. Packages from traditional "female" cavity molds were previously preferred because the conventional thermoform, vacuum assisted molding process resulted in a hinge which was thin and pliable compared to other package areas and thus able to readily flex and so act like a hinge, rather than merely being a stiff flange separating the cavity and the connected cover portion of the package. The usual female clamshell thermoform molding process results in a package having a relatively thick outer perimeter flange, because the plastic sheeting first contacts that part of the tool and so is not pulled and stretched to a lesser thickness during the molding process. The hinges of these known packages became thin as the warm plastic was pulled down into the female mold channel.

Because of limitations in the molding process, in order to have a female hinge, e.g. 312, the product panels or cavities (such as are shown, for example, at 314 and 316 in FIG. 11) formed at the ends of the mold also had to be formed female. The product cavity formed in such standard female clamshell packages necessarily had relatively thin bottoms and corners. This was a result of the warm plastic sheet being stretched as it was pulled by vacuum down into the mold cavity. Thus, the portion of the package containing the product was weak and subject to breakage and distortion, causing product wastage. In addition to the female formed hinges in these containers being weak, blemishes on the package surface occur as a result of the vacuum application through small holes in the mold. Furthermore, the corners of the female product cavities are often inconsistent in thickness.

In an attempt to overcome these problems, female molded clamshell plastic packages were sometimes made by addition to the tooling process of a male plug "assist", over which the warm plastic was partially formed before being placed under the stress of the vacuum pull. These packages are somewhat stronger, and offer the advantage that the hinge can be male, i.e., it can be shaped to extend in the same direction away from the mold axis as the male product cavity, opposite to the previously discussed female hinge on the usual female formed packages. However, the plug assist package corners were still relatively weak and the tooling for a combined female product cavity mold and male plug assist is very complicated and expensive to manufacture and maintain, resulting in a more expensive package, which ultimately adds to the final cost to the consumer.

Formation of the product cavity as a male, on the upper side of the tool, is generally preferred because as the heated plastic sheeting is draped over the tool, the protruding male, cavity-forming portion of the tool is the first area contacted by the heated plastic. Thus, that portion is one of the stronger parts of the resulting "male" clamshell package. It includes increased thickness at what becomes the face of the package product cavity, as well as uniformly thicker corner portions, for a better package appearance, as well as strength. This male package is also an improvement because the surface blemishes which are generally formed in female thermoformed packages do not occur.

Some early attempts at "male" thermoformed hinges were less than satisfactory because the hinges did not operate adequately, so as to permit the package panels, i.e., the product cavity and closure panel, to meet and seal well. Further, the feel and appearance of these hinges was unpleasant. Previously, there has not been a male tooled, thermoformed package with the hinge between the lid and the product cavity formed on the upper side of the tool, extending transversely in the same direction as the male tool product cavity forming side and having a triangular cross-section.

Normally, during the female clamshell molding process the sheet of warm plastic first comes in contact with the upper surface of the mold and that area generally forms a flange around the outer perimeter and is the thickest part of the package. The central portion of the plastic sheet is pulled, by vacuum, down into the mold and thus caused to thin as it conforms to the mold shape.

So, in the usual female clamshell package, with a female hinge, the product cavity becomes the thinnest part of the package and the flange is the heaviest part. This, of course, is the reverse of what is preferred in order to protect the product within the package. Because the plastic in the outer flange region of a male clamshell is stretched down over the mold before reaching the flange, this is the thinnest area of the package formed. From a functional standpoint, thinness in this area is acceptable. However, in the case of a product cavity which is thin, as in female clamshells, there is the risk of product damage due to puncture or crushing of the package.

In order to offset the above problem, and to make a stronger thermoformed package, the female-type thermoforming process has been modified in the art by adding some pressure forming; i.e., by using a male plug "assist" to aid with pressure in shaping the plastic into the female form cavity. Although this process results in an improved package over the original female vacuum-thermoformed clamshells, that is, a somewhat stronger package, the tooling for plug-assist package forming is much more complicated and so more expensive.

It is thus preferred, for economy, to form a clamshell package using only a male mold, rather than a male plug assist with a female mold, for simpler and less expensive tooling. With known male molds, thermoform package making (sometimes referred to as "drape-forming"), the heated roll stock plastic is draped over the upwardly extending male tool and then formed over the mold by vacuum and/or pressure to force the plastic down to vent holes in the bottom of the mold (an open concave area which does not touch the warm roll stock). The male clamshell tooling can include, for example, a standard base with a standard male hinge, but be capable of receiving interchangeable male product cavity molds to suit different product shapes. Thus, the mold for the new package and hinge can be suited for attachment, as by the usual bolt-on method, of a company's pre-existing male tool to a new mold base which has the appropriately shaped "male" raised triangular ridge structure thereon for forming the new male package hinge.

Optionally, this standard base can receive various interchangeable male tools, for forming product cavities of various shapes, and may have a closure panel which is the same for all packages to be formed on the mold, regardless of what shape is selected for the product cavity. For example, basically the same package may be desired for retail display of various types of sliced lunch meats. However, one run of packages may be made with annular product cavities for packaging bologna, and then the product cavity tool can be replaced with a substantially square tool for forming packages for pressed ham slices. Otherwise, the packages can have identical hinges and closure panels and can all be made on the same mold base contoured for forming those desired common package features (the hinge and/or closure panel).

In the new package, because the male hinge-forming part of the mold extends upwardly from the axis of the mold, the hot plastic sheeting drapes over it without being stretched thin, yet it readily flexes for opening and closing of the clamshell because of the pointed top surface (the apex of the triangle), which allows the bottom points (R, S) of the triangle to meet at the intersection of each side (X, Y) of the hinge triangle and the flange, and allows the hinge to function in a superior manner. The new clamshell panels now close and flanges touch and remain substantially flat in relation to each other.

To summarize, the problem has been that while female clamshell hinges are thin and very readily bendable, because of tooling problems the product cavity also has to be formed female, i.e., in a female mold. These female product cavities suffer from the disadvantage that they are weak, as well as the fact that they suffer from aesthetic problems. Male tooled product cavity clamshell packages have certainly been preferred, as they can be stronger and formed without surface blemishes. However, the problem has become, how to form a functional hinge on a package with a male formed product cavity. The answer has been found in forming a male hinge. That is, a hinge which extends in the same direction as the male tool on the package mold.

It has especially been found to be beneficial to make such a male hinge so as to have a triangular cross-section. Then, when the clamshell package is closed, the hinge folds with two flat side surfaces against one another, providing a double thickness end flange on the package, for extra strength and a smooth visually pleasing appearance and feel. In the usual female hinges, when the package is closed, the sides of the hinge do not fold substantially flat over each other, but instead have an open, rough cross-section configuration in closed-package position. In some known female clamshells this configuration takes a more or less cloverleaf shape, and in any event is not as firm and strong as the new male hinge.

Thus, it is among the several objects of the present invention to provide a product package which can be formed by a process of thermoforming, with a hinge which is sufficiently strong to be capable of many repeated openings and closings without breaking, and thus is intact after much use and is also aesthetically pleasing in appearance and feel. The new hinge is further expected to be capable of mass production in a male formed clamshell package, in an economical manner.

It is also among the objects of the present invention, having the features indicated, that the new package produced by the process described are reusable, being suitable not only for display of items for sale, but also for later storage of such items, or other products. Moreover, the mold base for forming the new thermoformed package hinge is intended to be suitable for interchangeable receipt of male tools for forming packages having varying shapes of product cavities.

Accordingly, in furtherance of the above objects, the present invention is, briefly, a male thermoformed package hinge a first side and a second side. Each of the first side and the second side have a first end and a second end and extend therebetween. The hinge has a triangular cross-section, the first side and the second side intersecting at the first ends thereof and thus forming the apex of the triangular cross-section. The hinge also has a first flange and a second flange, the first flange extends substantially horizontally from the second end of the first side and the second flange extends substantially horizontally from the second end of the second side in a direction opposite that in which the first flange extends when the hinge is positioned as on a male mold on which it is thermoformed. In the molding position the apex of the triangular cross-section of the hinge points away from the mold and an imaginary line drawn from the first flange to the second flange forms the base of the triangular cross-section.

The invention is also, briefly, a thermoformed package having a first portion and a second portion which are repeatedly openable and closeable with relation to each other and an integral hinge connecting the first portion and the second portion. The hinge is triangular in cross-section, the apex of the triangle extending in the same direction from the axis of the package as the product cavity panel of the package.

The invention is also, briefly, a thermoform process for forming a package having a male hinge. The process includes providing a thermoform mold base with a male product cavity panel tool, a closure panel tool and a male hinge tool between the male product cavity panel tool and the closure panel tool, the male hinge tool being formed as described above, heating a sheet of thermoformable plastic, positioning the heated sheet of thermoformable plastic over the mold, and applying a vacuum to form the heated thermoformed plastic over the mold.

The above mentioned and other objects and benefits of the present invention will be in part pointed out and part apparent in the figures and the description below.

BRIEF DESCRIPTION OF THE DRAWINGS

Throughout the drawings like parts are indicated by like element numbers.

DESCRIPTION OF PRACTICAL EMBODIMENTS

Figure 1A:
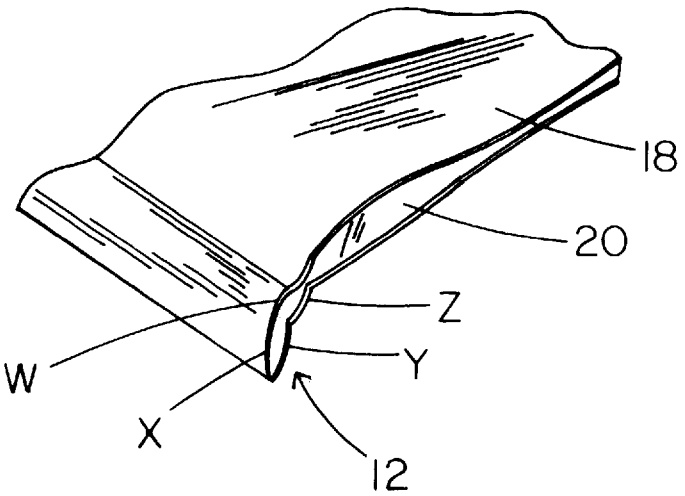
FIG. 1A is an enlarged view, broken away, of the hinge portion of the package shown in FIG. 1.

With reference to the figures, and particularly FIGS. 1 through 3A, initially, there is illustrated a thermoformed package, generally designated 10, having an integral hinge 12 and being constructed in accordance with and embodying the present invention. Package 10 has a product cavity panel 14 and an opposed closure panel 16 which is connected to product cavity panel 14 by integral hinge 12, which hinge is discussed in detail later herein.

Package 10 is preferably formed of any semi-rigid thermoformable plastic, such as, for example, polyvinyl chloride ("PVC"), and may be tinted with a color, but usually is clear for ready visualization of the product which is packed and sold within the package.

In keeping with the discussion in the Background and Summary of Invention, above, the product cavity panel 14 of package 10 is "male", having been formed on an upwardly protruding male mold portion (or tool) and closure panel 16 is "female" having been formed on an indented, or concave mold portion (the mold for this particular embodiment not being shown).

Each panel 14, 16 is provided at its perimeter with a flat flange or "snap ring" 18, 20, respectively. Optionally, one of the snap rings 18, 20 can have an extension, such as that shown at 22 on flange 20, for ease of gripping and separation of the flanges which overlay each other in the usual fashion when package 10 is closed. Extension 22 may be provided with at least one through-hole (not shown) to facilitate hanging of package 10 for display of product in the package.

Figure 1:
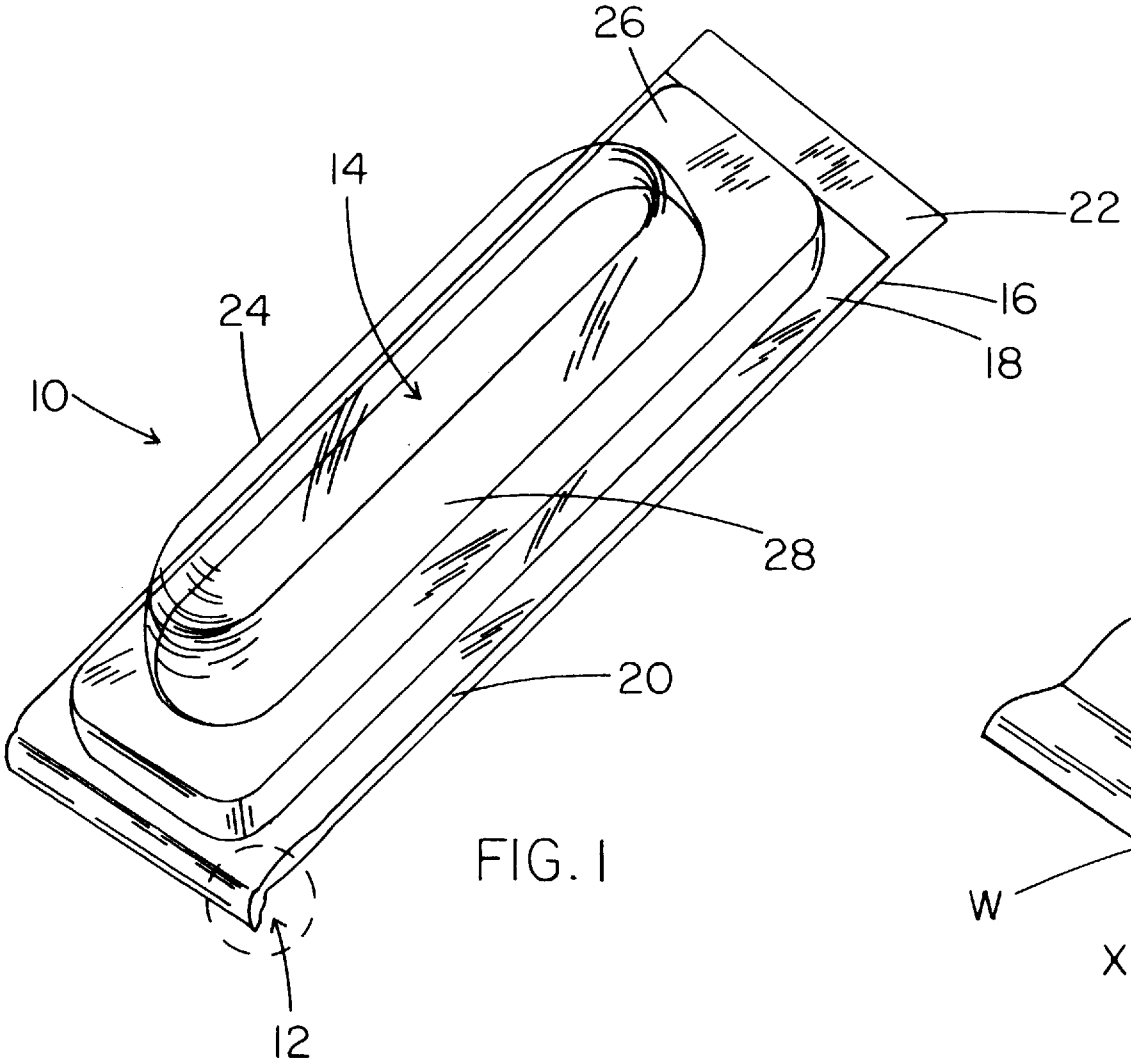
FIG. 1 is a perspective view of a thermoformed package having a hinge constructed in accordance with and embodying the present invention, the package shown in closed position.
Figure 2:
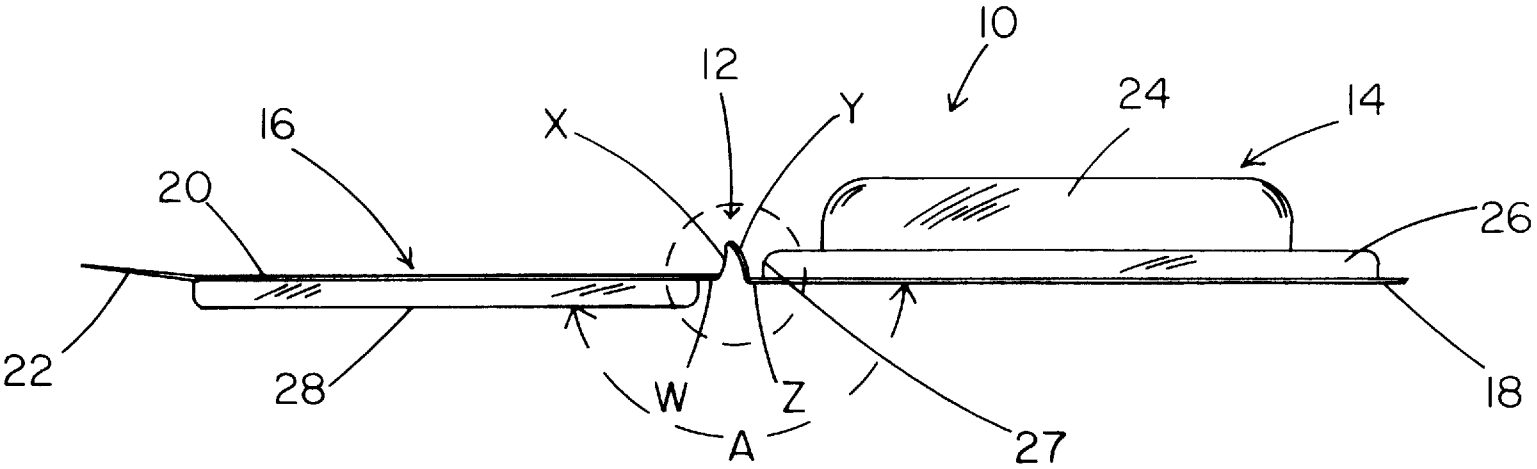
FIG. 2 is a perspective view of the package shown in FIG. 1, but in the open position, as formed.

Snap rings 18, 20 can be provided with known button-like detents (not shown), if desired, by which the flat flanges can be selectively, releasably held together in overlying snapping fashion, or, as shown in FIG. 1, panels 14, 16 can be removably fitted together, to the closed position shown in FIG. 1 from the open position shown in FIG. 2, as molded, by virtue of the snug fit of internally facing portions, to be described, of the two panels. Certainly, other structures, both known and yet to be conceived can be used to hold package sections 14, 16 together without departing from the scope of the invention.

It is to be understood that product cavity panel 14 and closure panel 16 can be formed in virtually whatever configuration is desired, in whatever shape is suitable for the particular product to be housed in package 10 for shipping, storage, display or sale, as the case may be. For example, FIGS. 5 through 8 illustrate an alternative embodiment, package 100, with a different product cavity panel 114 shape than in package 10. Package 100 is formed on a mold, such as that shown in FIG. 4, generally designated 110 and discussed further later herein.

Moreover, closure panel 16 could conceivably also be formed to protrude outwardly, in the same direction away from the longitudinal axis of open package 10 as does the cavity portion 24 of panel 14. In that instance, when closed, the new package would bulge outwardly on each side of the axis, away from the overlaying flanges 18, 20.

For storage or display of relatively flat items, such as trading cards, for example, one or both panels 14, 16 can be formed flat.

As seen in the open package 10 shown in FIG. 2, stepped portion 26 arises from perimeter flange 18 and turns inwardly to form a base from which product cavity 24 further protrudes. When the open package 10 of FIG. 2 is closed, in the direction indicated by arrow A (away from the hinge), so as to assume the position shown in FIG. 1, it is seen that the inside of stepped portion 26 is appropriately sized so as to serve as a force-fit receptacle for a correspondingly sized and shaped protruding area 28 of closure panel 16. When package 10 is thus closed, protruding area 28 forms a floor or backing for the inside of product cavity 24.

Of course the above-describe stepped configuration on package 10 can be omitted if preferred without departing from the scope of the new package and hinge invention. For example, if a product cavity panel of only one level or height is used, rather than being stepped,as at 26, the package can be closed using the known molded detent structures previously discussed; such as those shown, for example, in FIG. 6 at 132 and 132A. In that case, package closure panel 16, could merely be a flat sheet with closure detents formed at the edges thereof, spaced appropriately for engagement with corresponding detent portions on the facing flange of the product cavity panel.

Figure 2A:
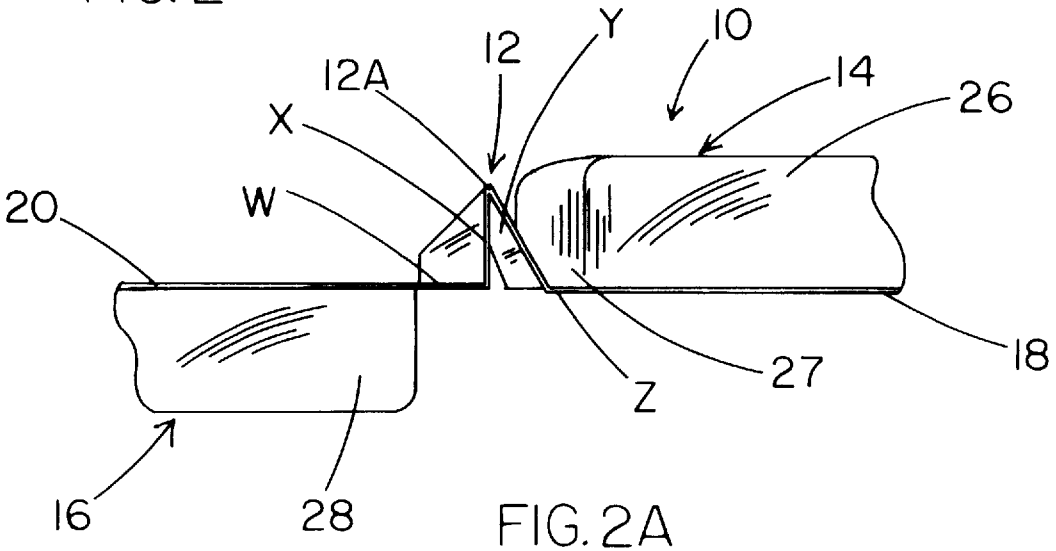
FIG. 2A is an enlarged view, broken away, of the hinge portion of the package shown in FIG. 2, turned slightly.

FIGS. 1A and 2A show new hinge 12 of package 10, enlarged for clarity, with the package closed in FIG. 1 and open in FIG. 2, more or less as the package would be removed from the mold.

FIG. 2A is an enlarged view, broken away, of the hinge portion 12 of the package 10 shown in FIG. 2, but with the angles shown more sharply, as they would appear just after molding of the package and prior to extensive flexing of the hinge.

As seen most clearly in FIG. 2A, hinge 12 is generally triangular (an upside down "v") in cross-section with apex 12A of the triangle extending outwardly, away from the axis of package 10 and to the same side of such axis as the male product cavity panel 14. Thus, hinge 12 is referred to as a "male" hinge. As shown in FIG. 1, hinge 12 is preferably as wide as and is contiguous with an entire end of the closed package 10. However, it is conceived that hinge 12 could be narrower than shown, or formed in sections with open spaces therebetween. These latter constructions of course would be weaker than the preferred structure shown.

For simplicity of discussion, the parts of hinge 12 will be referred to as walls or sections W, X, Y, Z. Each wall W, X, Y, Z, has an inner and an outer surface, the terms inner and outer referring to the inside and outside of package 10 in the closed position shown in FIG. 1. For simplicity of the drawings, FIGS. 1 through 2A have been positioned diagonally. However, it is to be understood that as normally formed on a mold, package 10 would be open as seen in FIG. 2, and substantially horizontal. When lifted from the mold, with the open face of product cavity 24 facing downwardly, closure of package 10 would be accomplished by flexing hinge 12 and bringing the opposed panels 14, 16 together, more or less along the arched path of approximately 180° described by arrow A in FIG. 2.

Further with regard to the detailed structure of hinge 12, wall W is essentially an extension of the molded material of flange 20 between downwardly extending stepped portion 28 of closure panel 16 and the extreme lower end of wall X, as seen in FIG. 2A, with package 10 open and extended. When package 10 is open and positioned substantially horizontally with the open side of cavity 24 facing down, wall X extends substantially vertically, upwardly from the line of intersection with surface W to the apex 12A of the triangle of the hinge cross-section, where it intersects with the upper edge of wall Y.

Continuing the above description, with hinge 12 in the same position, Wall Y extends at an angle, downwardly from apex 12A, and to the right of the figure, to a line of intersection with the left edge of wall Z. Wall Z in turn extends substantially horizontally, to the right of the figure, effectively as a part of flange 18, to intersect with the upwardly rising hinge-directed end 27 of stepped portion 26, the base of product cavity 24.

The relative positioning of the hinge walls W, X, Y, Z of hinge 12 in the package closed position is illustrated in FIG. 1A. In this figure, apex 12A of the previously described (open position) triangular hinge is shown to have been pulled downwardly the left, so that the closed hinge 12 forms a smooth, curved extension at the leftwardly directed end of the figure.

Hinge sections W and Z which were positioned when open at opposite extremes of the open hinge triangle are now, in closed positioned, adjacent one another with the respective inside surfaces thereof facing, and hinge sections X and Y are positioned adjacent one another with respective inside surfaces thereof facing and are still conjoined at apex 12A, preferably contiguously with the width of the package.

In all embodiments of the new male, triangular cross-section thermoform hinge, it is preferred for optimal performance that the respective combined edge lengths of W and X substantially equal the combined edge lengths of Y and Z. These preferred combination of relative hinge wall dimensions are schematically illustrated for a few different embodiments of the new hinge in FIGS. 3A, 3B, and 3C. These embodiments are offered only as examples and are not intended to be exclusive.

Figure 3A:
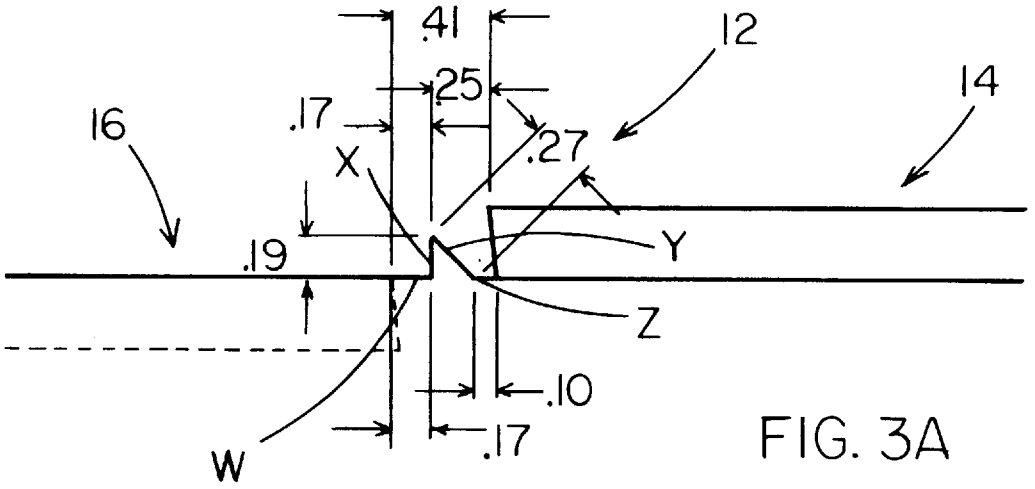
FIG. 3A is a schematic cross-sectional view of the hinge of the package shown in FIG. 1.

FIG. 3A is a schematic cross-sectional view of the hinge of the package shown in FIG. 1, showing an example of some specific dimensions (in inches) which will permit hinge 12 to function properly, and a cross-section of the hinge forming a right triangle having a vertical side closer to the "female" closure panel 16 side than to the "male" product cavity panel 14 package side. This embodiment illustrates the preferred structure of the new hinge and is substantially the same as hinge 12, shown as part of package 10 in FIGS. 1 through 2A.

Figure 3B:
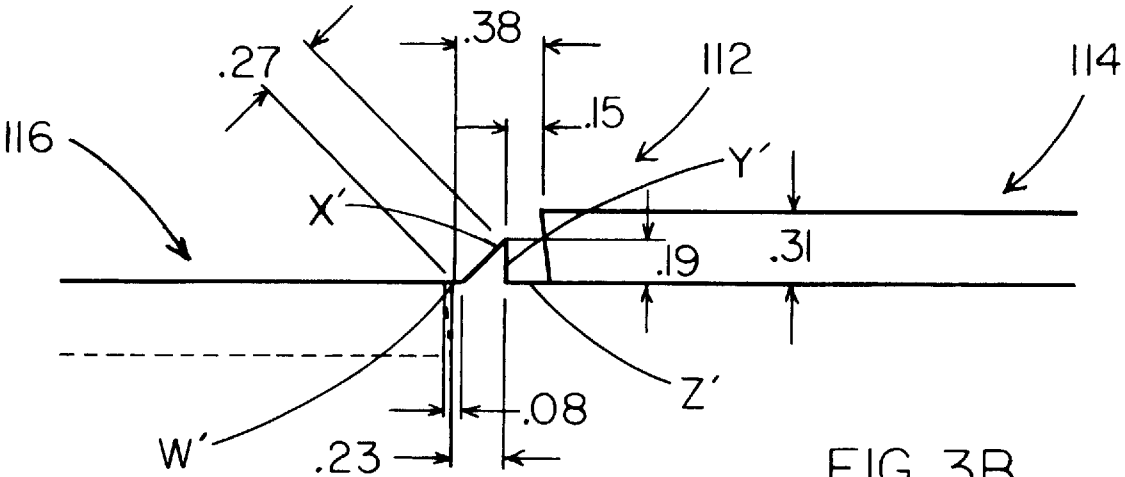
FIG. 3B is a schematic cross-sectional view of an alternative embodiment of the hinge of the package shown in FIG. 1.

FIG. 3B is a schematic cross-sectional view of an alternative embodiment 112 of the new hinge, for a package which can, if desired, otherwise be identical to that shown in FIG. 1, as an example, showing some specific dimensions (in inches), and with the cross-section of hinge 112 being a right triangle having a vertical side (with relation to the plane of the package panels, or to the horizontal base of the mold on which the package is formed) closer to the "male" product cavity side 114 than to the center or to the "female" closure panel side 112 of the package. Thus, in this embodiment the triangle position of the hinge (i.e. the position of the right angle) is reversed as compared to the embodiment shown in FIGS. 1 through 3A.

Figure 3C:
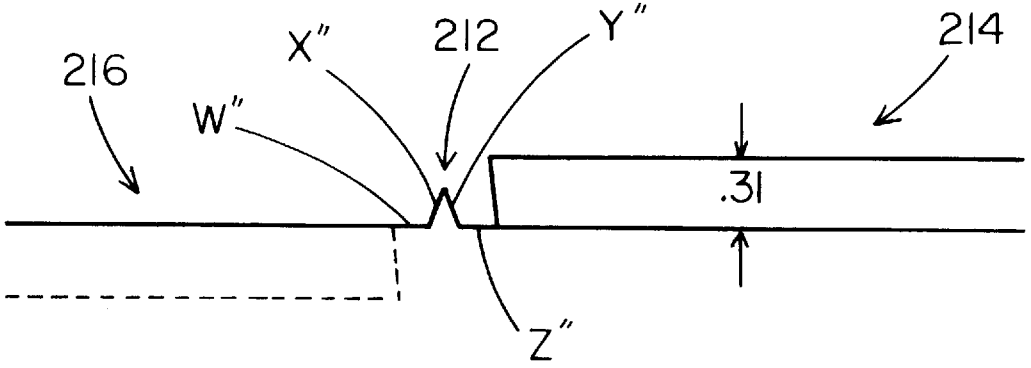
FIG. 3C is a schematic cross-sectional view of another alternative embodiment of the hinge of the package shown in FIG. 1.

FIG. 3C is a schematic cross-sectional view of another alternative embodiment 212 of the new hinge for a thermoformed package such as that shown in FIG. 1, for example, with the cross-section of the hinge formed instead as an isosceles triangle with the apex 212A extending in the same direction as male product cavity panel 214, substantially equidistant between the male product cavity panel 214 and female package closure panel 216.

Figure 4:
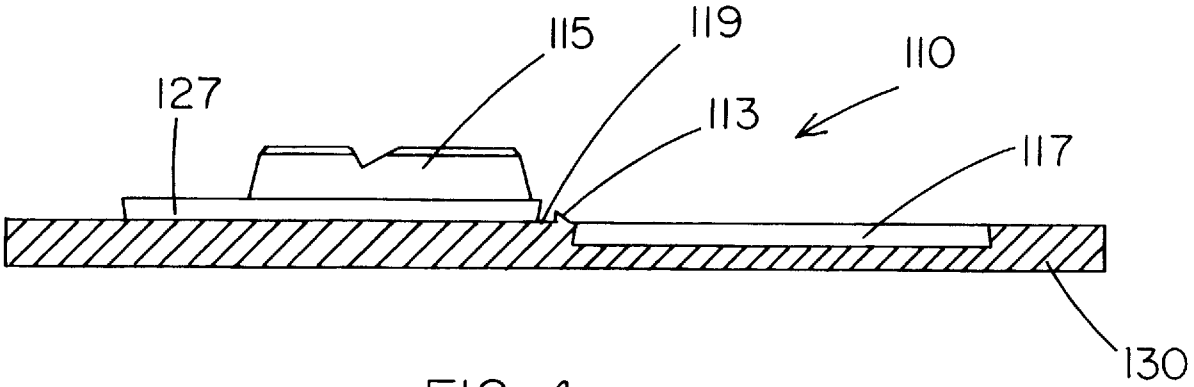
FIG. 4 is a schematic partial longitudinal sectional view of a mold of the type used to form a package having a hinge of the embodiment shown in FIG. 3B, the "male" side of the mold which forms the package product cavity being on the left side of the figure and the "female" side of the mold for forming the closure panel of the package being on the right side of the figure.

FIG. 4 is a schematic partial longitudinal sectional view of a mold 110 of the type used to form a package 100 having a hinge 112 of the embodiment shown in FIG. 3B, the "male" side of the mold 115 which forms the package product cavity 114 being on the left side of the figure, and including a foundation 127 for forming the stepped portion and the "female" side of the mold 117 for forming the closure panel 116 of the package 100 being on the right side of the figure.

The hinge-forming portion 113 of mold 110 extends upwardly at approximately the center of the mold and above the upper surface of the mold base 130. It is to be understood that the mold shown here is merely one embodiment which is suitable for forming the new package and hinge. It can be readily understood upon view FIG. 4 that when a hot plastic thermoform sheet is draped over mold 110 it will contact the apex of the male hinge forming projection 113 before being stretched by vacuum down into the channel 119 between portion 113 and the male foundation section 127. Thus, the apex of hinge 112 so formed necessarily will be thicker than the side walls X', Y' on each side of the apex.

As explained above, the product cavity forming portion 115 of the mold 110 can be simply attached by bolts and interchanged as desired on base 130 with a male cavity forming portion of a different shape, as may suit the needs of a particular package manufacturer's customer. The female, panel closure side 117 and hinge forming portion 113 can be of different forms as well, but are integral with the base 130 and therefore cannot be selectively interchanged on a given base.

Figure 5:
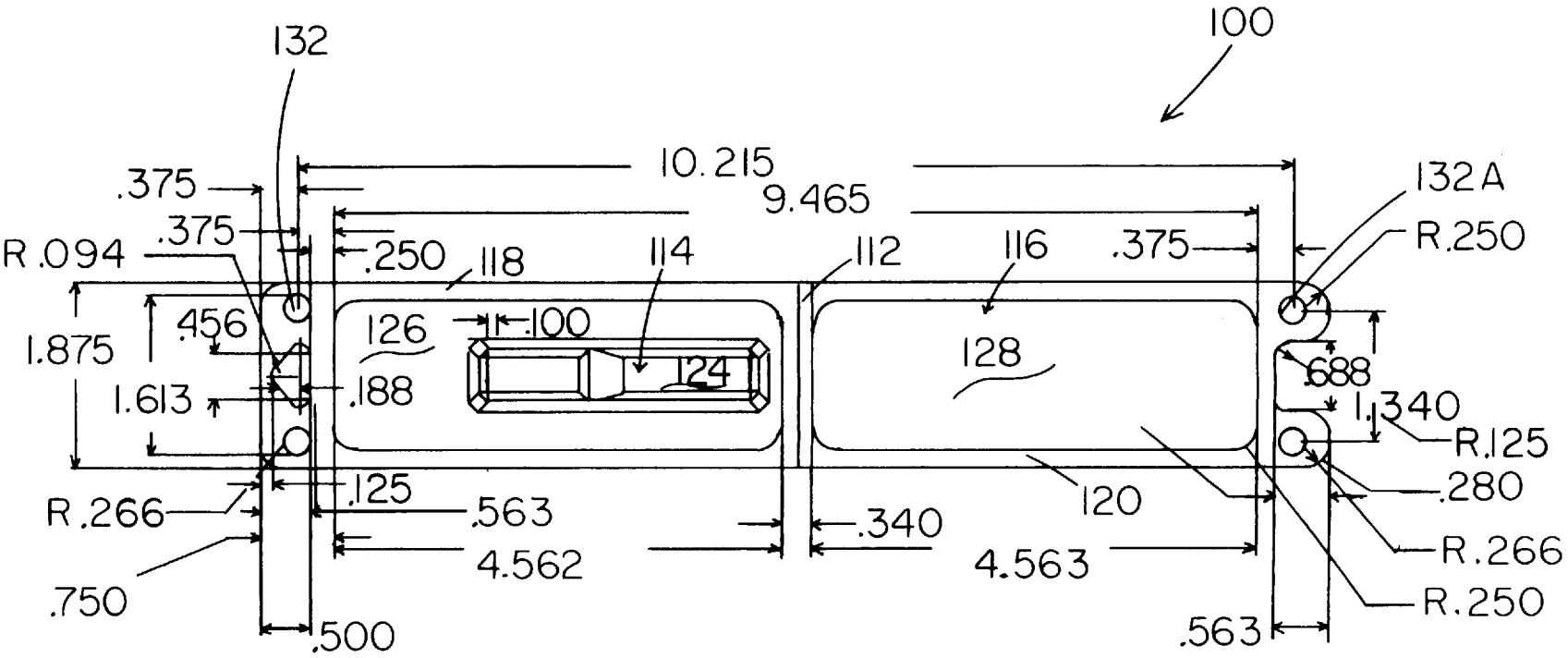
FIG. 5 is a schematic top plan view of a package having a hinge of the embodiment shown in FIG. 3B, and showing specific dimensions, as one example of the invention, as would result from use of a mold of the type shown in FIG. 4.

FIG. 5 is a schematic top plan view of package 110 having a hinge 112 of the embodiment shown in FIG. 3B, and showing specific dimensions, as one example of the invention, as would result from use of a mold 110 as shown in FIG. 4, for example. Optional interlocking detent button structures 132, 132A are indicated schematically in package flanges 118, 120, respectively. Alternatively, these sites can be formed as through-holes for purposes of hanging package 100 or they can be omitted altogether.

As with the previously described embodiment 10, in package 100 there is a male portion or product cavity panel 114 which includes the product cavity 124, per se, and an opposed female package closure panel 116 with a central depressed area 128 which, when package 110 is closed, is force-fitted into a raised, stepped area 126, the base of the male product cavity 124.

Figure 6:
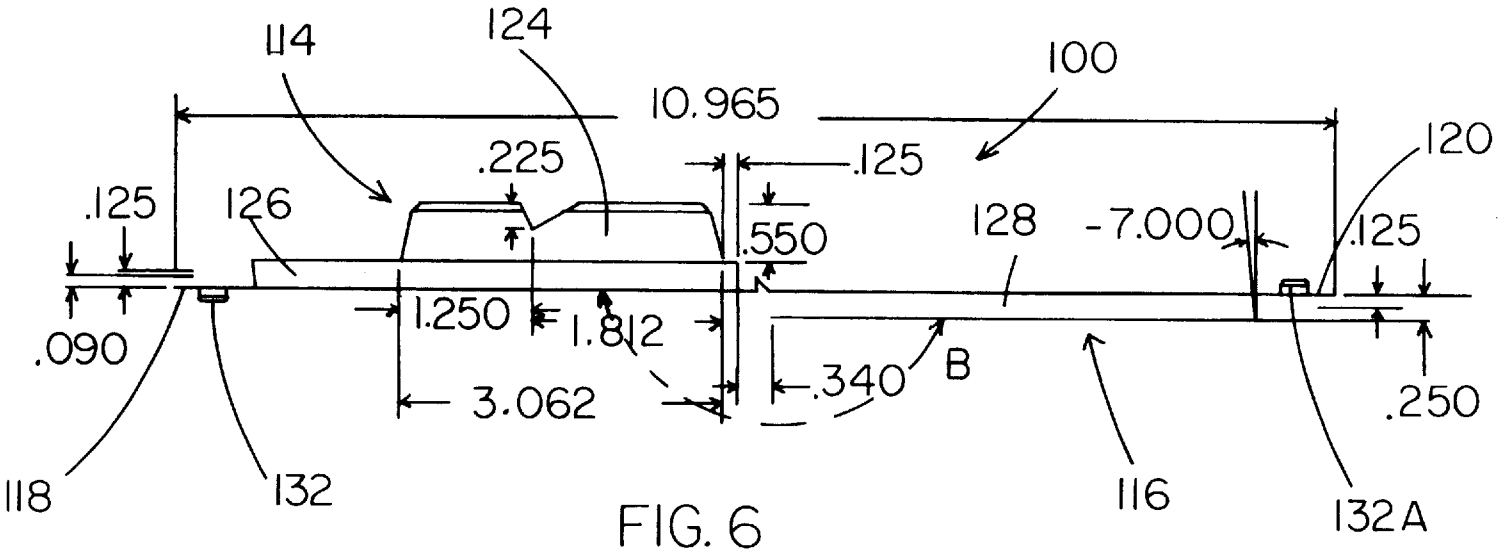
FIG. 6 is a schematic side elevational view of the package of FIG. 5.

FIG. 6 is a schematic side elevational view of a package 100 formed on the mold 110 of FIG. 4. Arrow B indicates that package 100, like package 10 closes with the lower sides (from the position shown in the figure) of the panels 114, 116 toward each other. Thus, as in hinge 12, the inside surfaces of the hinge walls will foldably close substantially flat against each other, in overlying fashion.

Figure 7:
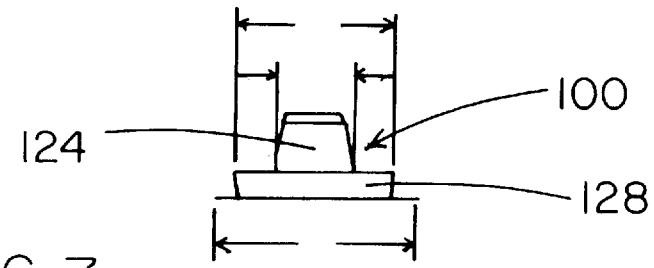
FIG. 7 is a schematic end elevational view of the package of FIG. 5, as seen from the left end of FIG. 6.

FIG. 7 is a schematic end elevational view of the package 100 of FIG. 5.

Figure 8:
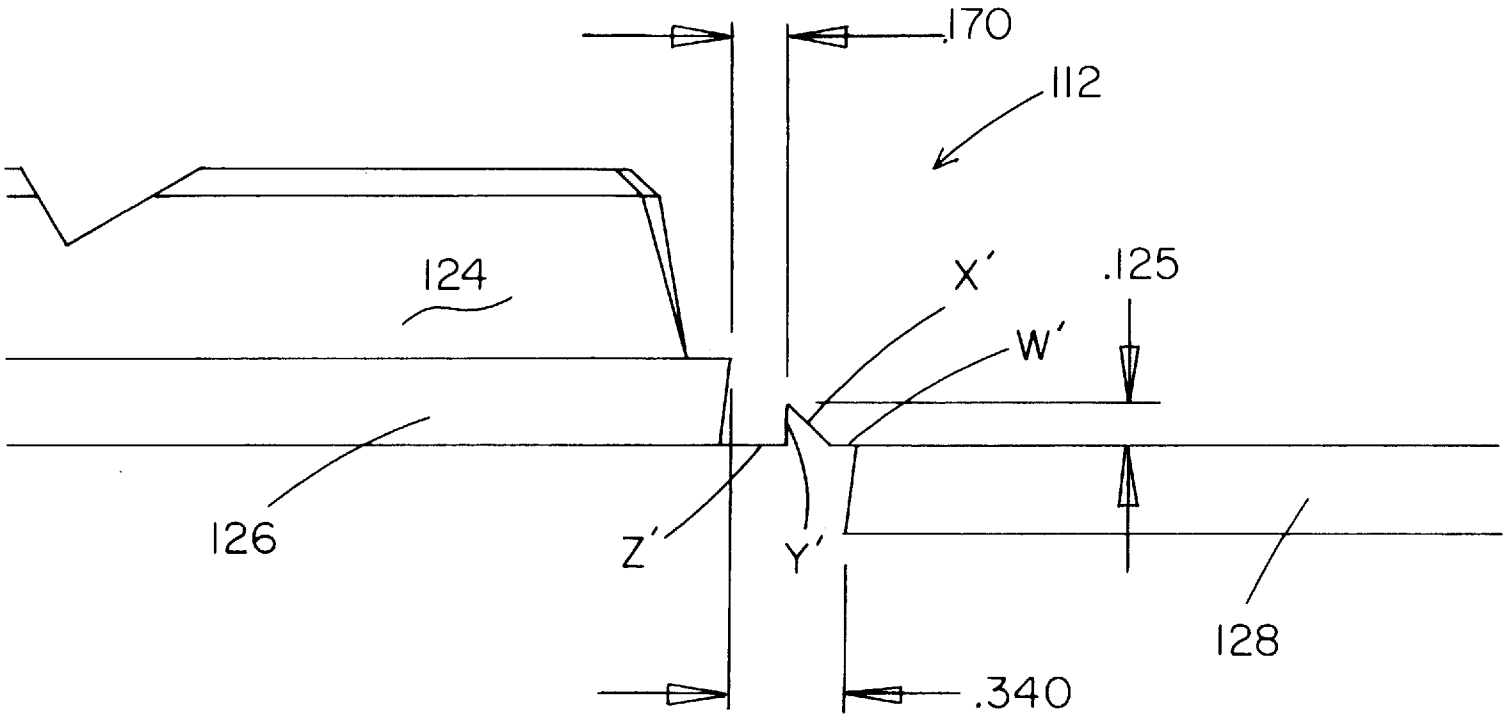
FIG. 8 is an enlarged view of a portion of FIG. 6, showing the package hinge area more clearly.

FIG. 8 is an enlarged view of a portion of FIG. 6, showing the package hinge 112 area more clearly. Thus, it should be understood by viewing FIGS. 6 and 8, that when lid portion 116 of package 100 is folded from the formed position shown to the closed position around hinge 112 (downwardly and to the left of the figure; clockwise, from the viewpoint illustrated in FIG. 6), the inside surfaces of walls X' and Y' will be facing each other and the inside surfaces of walls W' and Z' will be facing each other. This would also be the case with corresponding hinge wall portions X" and Y", as well as W" and Z" of a package formed with the alternate hinge 212 illustrated in FIG. 3C.

FIG. 8 also shows certain hinge dimensions, in inches, which will permit hinge 112 to function as desired. It is to be understood that these specific dimensions are provided as examples only and the invention is not to be limited thereto.

It is to be understood that any of the new hinges illustrated and described, and other possible embodiments of a male, triangular cross-section thermoformed hinge can be used with either of the molded package configurations illustrated, or with other possible male thermoform package shapes, which are too numerous to show.

Figure 9:
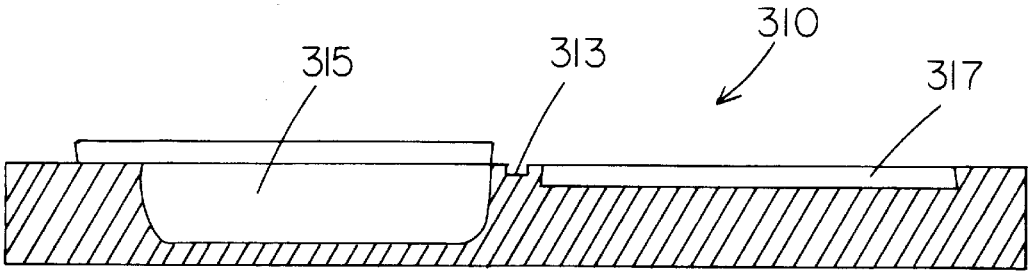
FIG. 9 (PRIOR ART)
FIG. 9 is a schematic partial longitudinal sectional view of a conventional female mold used to thermoform packages known in the art.

FIG. 9 is a schematic partial longitudinal sectional view of one type of a conventional female mold 310 used to thermoform packages known in the art.

Figure 10:
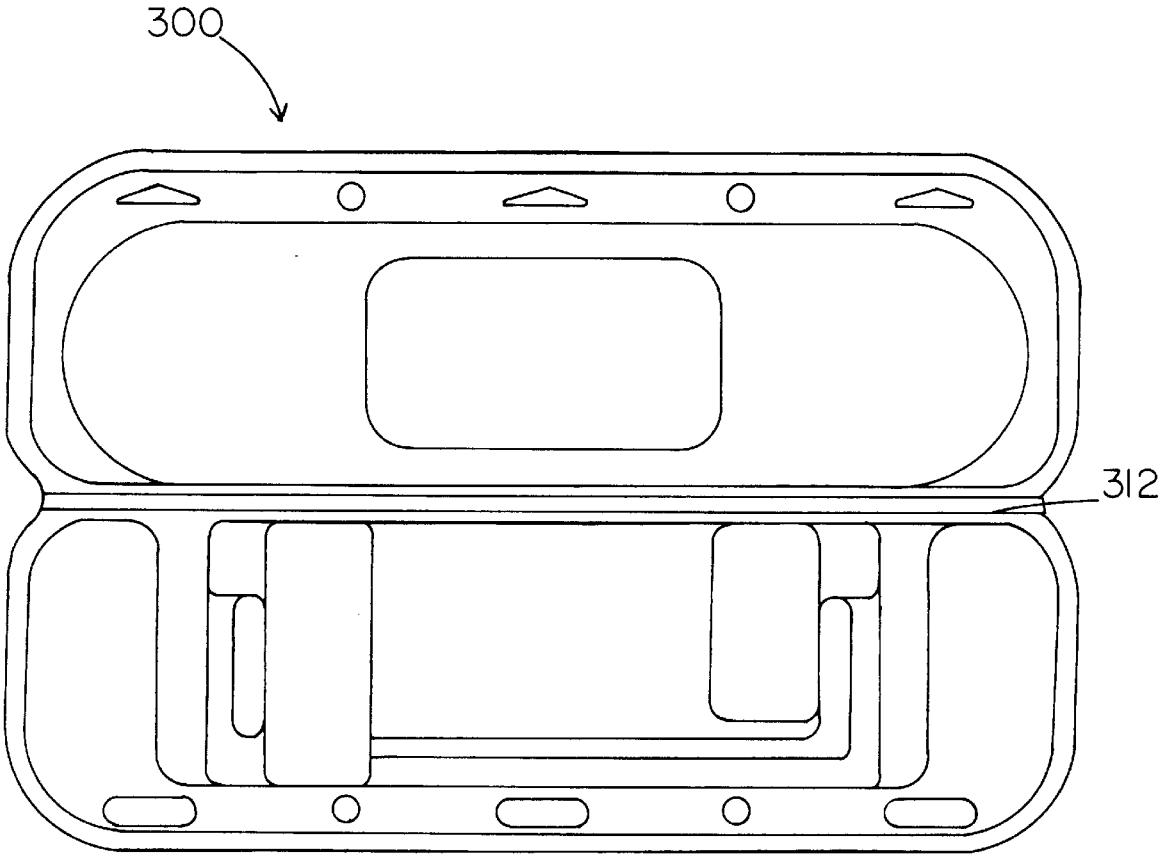
FIG. 10 (PRIOR ART)
FIG. 10 is a schematic top plan view of a package of a type formed with a mold of FIG. 9.

FIG. 10 is a schematic top plan view of a package 300 of a type formed with a mold 310 of FIG. 9, and generally referred to as a female clamshell.

Figure 11:
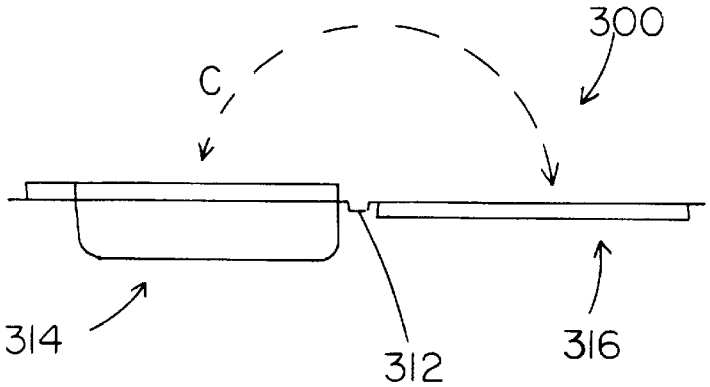
FIG. 11 (PRIOR ART)
FIG. 11 is a schematic end elevational view of the package shown in FIG. 10.

FIG. 11 is a schematic end elevational view of the known female package 310 shown in FIG. 10, showing the female formed hinge 312. When removed from mold 310, package 300 would be in generally the position shown and to be closed, panels 314, 316 would be brought together as indicated by arrow C, with lid portion 316 rotating counter-clockwise from the forming position, upwardly and to the left, as shown from the direction illustrated in FIG. 11. In other words, and by comparison to the above description of the invention, package 300, like all female thermoformed packages with female hinges, closes opposite the way the new male thermoformed package with a male, triangular, cross-sectioned hinge closes.

Figure 12:
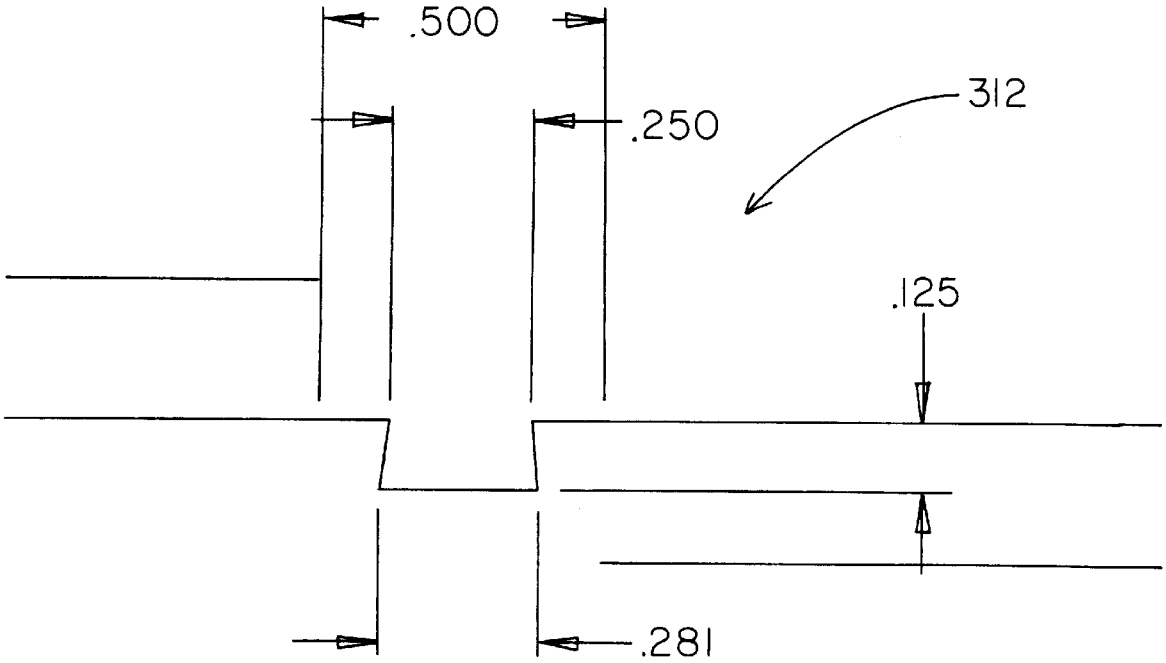
FIG. 12 (PRIOR ART)
FIG. 12 is an enlarged schematic view of the hinge area if the known package of FIG. 11.

FIG. 12 is an enlarged schematic view of the hinge area 312 of the known female thermoformed package 300, showing examples of typical dimensions, in inches. It is noted that hinge 312 extends in the same direction as the concave, female product cavity portion of package 300, relative to the horizontal, and in the direction opposite that in which the male product cavity and hinge of the new male thermoformed package extend when formed.

Accordingly, in view of the described structure for the new thermoform package and hinge, great advantages are offered over the known art. As explained above, the product cavity portion of most male clamshell packages is stronger than on comparable female clamshells, because in the thermoforming process the plastic sheet touches the male cavity face and edges of the mold first, instead of last, as in the female molding process. There are two types of thermoforming. The simplest is vacuum forming where one form tool, either male of female, is used and the plastic is simply draped over it, formed, cooled and then removed. Although tooling is simple in that case, the material can only be manipulated by the design of the single mold used. As explained, male clamshell packages can be vacuum formed with results which are superior to those obtained with female clamshells.

Pressure forming is the second type of thermoforming. It utilizes a forming tool (usually female) and a plug assist. The entire forming area is trapped off from the surrounding atmosphere and requires a complex combination of machine parts, including a chilled female form tool and temperature controlled male plug assist. This process also requires a top applied vacuum, bottom applied pressure and complicated tool cycling (often computerized) to produce a part with more uniform material distribution than is made by vacuum forming. The results usually are superior to vacuum forming, yet with the present invention the complexities of pressure forming are not necessary to produce an aesthetic, strong and functional clamshell.

The molding process involved in male thermoforming, with the material used usually being any semi-rigid thermoplastic sheet, is entirely adequate for formation of the new hinge and package. In the present invention, the male hinge formed as described between the panels of a typical thermoform clamshell tool with a snap ring closure, the male clamshell can be closed in the opposite direction as is standard for female clamshells. The standard thermoformed clamshell panels are folded along a female channel that becomes thin as a result of the forming process. These thin channels will distort and buckle.

The new male hinge works in a superior manner because of the perfected design of its walls. The plastic material is thinned only in the appropriate areas so that the closure panel folds away from the male product cavity protrusion and results in the adjacent panels (the product cavity and the closure therefor) overlapping so that they can be held together with a standard undercut snap ring closure system. In the new package, because the male hinge-forming part of the mold extends upwardly from the axis of the mold, the hot plastic sheeting drapes over it without being stretched thin, yet it readily flexes for opening and closing of the clamshell because of the pointed top surface (the apex of the triangle), which allows the bottom points (R, S, FIG. 3C) of the triangle to meet at the intersection of each side (X, Y) of the hinge triangle and the flange, and allows the hinge to function in a superior manner. The new clamshell panels now close and flanges W", Z" to touch or nearly touch and remain substantially flat in relation to each other.

The new male clamshell package having the new triangular cross-section, male tooled, thermoformed hinge is of great value in the production of thermoformed packages for consumer product packaging because the simpler male product cavities can be facilely bolted onto a pre-existing base, rather than requiring complex machining, cooling and evacuating of female tool cavities. Further, the male clamshell requires no plug assist to push material into low tool areas. Because of these advantages, there is an average tool cost savings of approximately 75% realized, in part because less aluminum is required, and lead times on orders are substantially reduced.

To date, the thermoforming industry has concentrated on improving female pressure forming and has overlooked male shapes and simple vacuum forming methods have thus been discounted as a process used only by low technology companies. However, the new male hinge is not only of a great value to many companies, it is beneficial in reducing the amount of technology and tooling required for making disposable, reusable thermoform clamshell packaging for consumer products.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions and methods herein described and illustrated without departing from the scope of the invention, it is intended that all matter contained in the foregoing description or shown in the accompanying drawings shall be interpreted as illustrative rather than limiting.

What is claimed is:

1. The combination of a thermoformed package having at least one product cavity and an integral thermoformed hinge (12); the thermoformed hinge comprising: a first side (X) and a second side (Z), the first side having a first end and a second end, the first side extending between the first end and the second end of the first side, the second side having a first end and second end, the second side extending between the first end and the second end of the second side, the thermoformed hinge having a triangular cross-section when the thermoformed package is in a completely open position, the first side of the hinge and the second side of the hinge intersecting with each other at the respective first ends thereof and thus forming an apex (12A) of the triangular cross-section, the thermoformed hinge also having a first flange (W) and a second flange (Z), connected to the first side of the hinge and the second side of the hinge, respectively, and being positioned so that the first flange extends substantially horizontally from the second end of the first side of the hinge and the second flange extends in the same plane as the first flange, substantially horizontally from the second end of the second side of the hinge, in a direction opposite that in which the first flange extends when the thermoformed package and the hinge are positioned in a fully open position, with a product cavity of the package opening downwardly, the apex formed by the intersecting respective first ends of the first side and the second side of the hinge pointing substantially upwardly, and a line drawn from the point of intersection of the second end of the first side of the hinge with the first flange of the hinge to the point of intersection of the second end of the second side of the hinge with the second flange of the hinge forms the base of the triangular cross-section of the hinge.

2. The combination of claim 1, wherein the thermoformed package comprises a first portion and a second portion which first portion and second portion are repeatedly openable and closeable with relation to each other, the hinge being disposed transverse to and connecting said first package portion and said second package portion, and the at least one product cavity being located in at least one of said first package portion and said second package portion, said hinge being triangular in cross-section when the package is in the open position, and having an apex of the triangle extending in the same direction from the axis of the package as the direction in which the male product cavity panel of the package extends when the package is in a fully open position.

3. The combination of claim 1, wherein the hinge extends away from the interior of the product cavity of the package when the package is in a closed position.

4. The combination of claim 1, wherein the hinge first side and the hinge second side each have an outer surface and an inner surface relative to the position of the hinge when the hinge is closed, and the first flange and the hinge second flange each have an outer surface and an inner surface relative to the position of the hinge when the hinge is in a closed position, the respective inner surfaces of the first side and the second side of the hinge are disposed substantially flat, in overlaying position, facing one another, and the respective inner surface of the first flange and the second flange are disposed substantially flat, in overlaying position, facing one another, to thereby provide the hinge in closed position with a strong double thickness.

5. The combination of claim 2, wherein the package further comprises a stepped portion (26) formed on the package first portion, spacedly inwardly from the intersection of the hinge first side with the hinge first flange, and a protruding portion formed on the package second portion, spacedly inwardly from the intersection of the hinge second side with the hinge second flange, the stepped portion being appropriately sized and shaped so as to serve as a force-fit receptacle for the protruding portion.

6. A thermoformed package having a first panel and a second panel connected to the first panel in a manner which permits repeated opening and closing of the package, at least one of the first panel and the second panel having a product cavity formed therein, and further comprising an integral flexible hinge connecting the first panel to the second panel, the hinge having and first side and a second side, the hinge first side having a first end and a second end, and the hinge second side having a first end and a second end, the hinge being elongated and extending transversely relative to the length of the package, the respective first ends of the hinge first side and second side intersecting with one another contiguously along the transverse extent of the hinge and forming, in cross-section, the apex of a triangle, which triangle apex points in substantially the same direction as the product cavity when the package is in a fully opened position with the package first panel and the package second panel extending in opposite directions, away from one another, the hinge also having a first flange and a second flange, the first flange extending substantially horizontally from the second end of the first side of the hinge and the second flange extending in the same plane as the first flange, substantially horizontally from the second end of the second side of the hinge, in a direction opposite that in which the first flange extends, so that a line drawn from the point of intersection of the second end of the first hinge side with the first hinge flange to the point of intersection of the second end of the second hinge side with the second hinge flange forms the base of the triangular cross-section of the hinge, the hinge first side forming a vertical right angle with the base of the triangle when the package is in such fully opened position and the product cavity is open and facing downwardly.

7. A male thermoformed package comprising a first panel; and a second panel movably connected to the first panel in a manner which permits repeated opening and closing of the package, at least one of the first panel and the second panel including a male product cavity, wherein the improvement comprises a bendable, integral male hinge portion disposed between and connecting the first panel and the second panel, the male hinge portion comprising a first side (X) and a second side (Z), the first hinge side having a first end and a second end, the first hinge side extending between the first end and the second end of the first hinge side, the second hinge side having a first end and second end and the second hinge side extending between the first end and the second end of the second hinge side, the hinge portion of the package having a triangular cross-section when the package is in a completely open position, the first side of the hinge and the second side of the hinge intersecting with each other at the respective first ends thereof and thus forming an apex of the triangular cross-section, the hinge portion also having a first flange and a second flange, the first flange extending substantially horizontally from the second end of the first side of the hinge portion and the second flange extending in the same plane as the first flange, substantially horizontally from the second end of the second side of the hinge, in a direction opposite that in which the first flange extends when the thermoformed package and the hinge portion are positioned in a fully open position, with the first panel and the second panel of the package extending away from each other in opposite directions, so that when a product cavity of the package opens downwardly, the apex formed at the intersecting respective first ends of the hinge first side and the second side points upwardly, and a line drawn from the point of intersection of the second end of the first side of the hinge with the first flange of the hinge to the point of intersection of the second end of the second side of the hinge with the second flange of the hinge forms the base of the triangular cross-section of the hinge.

8. The male thermoformed package of claim 7, wherein the male product cavity portion of at least one of the first panel and the second panel is greater than 0.5 inches in depth.

* * * * *

UNITED STATES PATENT AND TRADEMARK OFFICE

CERTIFICATE OF CORRECTION

PATENT NO. : 5,849,378

DATED : December 15, 1998

INVENTOR(S) : Gask, Bryan R.

It is certified that error appears in the above-indentified patent and that said Letters Patent is hereby corrected as shown below:

Col.12, Claim 4, line 47 before "first" insert --hinge--.

Signed and Sealed this

Fourth Day of May, 1999

*Attest:*

*Attesting Officer*

Q. TODD DICKINSON

*Acting Commissioner of Patents and Trademarks*